US005127880A

United States Patent [19]

Bar et al.

[11] Patent Number: 5,127,880

[45] Date of Patent: Jul. 7, 1992

[54] MULTIPLE PART GUEST CHECK BUSINESS FORM

[75] Inventors: James P. Bar; Kenneth D. Riggs, both of Glenview, Ill.

[73] Assignee: Moore Business Forms, Inc., Grand Island, N.Y.

[21] Appl. No.: 595,455

[22] Filed: Oct. 10, 1990

[51] Int. Cl.[5] ..... B41L 1/22

[52] U.S. Cl. ..... 462/18; 462/901; 283/60.2

[58] Field of Search ..... 282/9 R, DIG. 2; 283/60.1, 60.2, 30, 31; 462/18, 19, 20, 21, 53, 54, 901

[56] References Cited

U.S. PATENT DOCUMENTS

| | | | |
|---|---|---|---|
| 1,718,799 | 6/1929 | Phillips | 462/20 |
| 4,611,826 | 9/1986 | Breen | 282/9 R X |
| 4,687,228 | 8/1987 | Maldergham et al. | 282/9 R |
| 4,772,048 | 9/1988 | Engle et al. | 282/9 R |
| 4,772,049 | 9/1988 | Engle | 282/9 R |
| 4,938,507 | 7/1990 | Ashby et al. | 282/9 R |

OTHER PUBLICATIONS

"Royal Ocean Terrace" Guest Check.

*Primary Examiner*—Joseph M. Gorski
*Assistant Examiner*—Peter Dungba Vo
*Attorney, Agent, or Firm*—Nixon & Vanderhye

[57] ABSTRACT

A guest check business form will properly align with and be read by conventional guest check processing machines. The top part of a first, heaviest ply of the guest check has machine readable indicia (e.g. bar code) printed on it. Below the bar code second and third plies are attached to the first ply adjacent their top edges, with the bottom edges of all of the plies substantially in alignment. The adhesive attaching these plies is staggered so that at no point along the form is there adhesive more than one layer thick. The adhesive may be repositionable adhesive, or permanent adhesive. With permanent adhesive it is desirable to provide fine perforations in the second and third plies just below the adhesive attachment of them to the first ply. The first ply is preferably carbonless CF paper, the second ply carbonless CFB, and the third ply carbonless CB.

18 Claims, 1 Drawing Sheet

MULTIPLE PART GUEST CHECK BUSINESS FORM

BACKGROUND AND SUMMARY OF THE INVENTION

In many commercially available guest check type business forms, machine readable indicia, such as bar codes symbols, are provided to facilitate computerized processing of the forms. There are a number of commercially available pieces of equipment for that purpose, including the NCR 2160 reader manufactured by NCR Corporation of Dayton, Ohio.

Typical forms for that purpose comprise multipart forms in addition to single part forms. Multipart guest checks utilizable with such equipment are exemplified by the forms shown in U.S. Pat. Nos. 4,772,048 and 4,772,049.

In most commercial three-part forms with bar codes on the top thereof, the form has a triple thickness throughout its entire length. This means that the thickness of the form being read by the machine, such as an NCR 2160 reader, must properly receive and read a triple thickness of form. This results in difficulties in both feeding and reading when the form is inserted into the machine, and can result in the form being misaligned so that it is not properly scanned by the machine.

In order to solve the problem identified above, according to the present invention a multipart business form is provided wherein the top part of the form is only a single thickness. Second and third plies are operatively attached to the first ply so that the top edges thereof are spaced from the top edge of the first ply, but so that the bottom edges of all the plies are in substantial alignment. The bar code, or like machine readable indicia, is printed on the first ply at the portion thereof above the top edges of the second and third plies. Preferably, the first ply is made of a heavier paper than the second and third plies, e.g. 35 pound carbonless paper instead of about 15 pound carbonless paper for the other plies. The first ply is preferably CF, the second ply CFB, and the third ply CB.

The second and third plies are attached to the first ply by adhesive adjacent the top edges thereof. In order to allow proper reading, and subsequent feeding, avoiding the problems with the prior art discussed above, the first and second bands of adhesive attach the second and third plies, respectively, directly to the first ply, and are staggered, one being closer to the top edge of the first ply than the other, so that at no point does the guest check have adhesive more than one layer thick. As indicated, this is especially desirable in insuring proper feeding of the guest check form into the reader, and subsequent advance through the reader, for example, when printing is applied to the third ply by the reader.

The adhesive connecting the plies together adjacent the top edges of the second and third plies comprises the only means for connecting the plies together. The adhesive may be repositionable adhesive, or permanent adhesive. If it is permanent adhesive, then it is preferred that perforations be provided adjacent the adhesive line, on the portion thereof closest to the bottom edge of the plies. The perforations may be fine perforations, e.g. about 50 per inch or more, with ties having a length of no greater than 0.010 inches between them.

According to the preferred form of the invention, a guest check business form is provided comprising: a first ply having machine readable indicia printed on a first face thereof and having a first length and width, a top edge, and a bottom edge; a second ply having substantially the same width as the first ply, but of shorter length, and having a top and bottom edge; first adhesive means for attaching the second ply directly to the first ply first face so that the bottom edges thereof are in alignment, and the top edge of the first ply is spaced from the top edge of the second ply; a third ply having a length greater than that of the second ply but less than that of the first ply, having substantially the same width as the first and second plies and a top and bottom edge; second adhesive means for operably attaching the third ply directly to the first ply adjacent the top edge thereof, so that the bottom edges are in alignment, and the top edge of the third ply is spaced from the top edge of the first ply, the third ply overlying the first ply, the first and second adhesive means being staggered along the length of the first ply so that at no point does the business form have adhesive more than one layer thick; and the machine readable indicia printed on the first ply first face being printed thereon between the top edge of the first ply and the top edge of the third ply.

The invention also contemplates a method of utilizing a guest check business form according to the invention. That method comprises the steps of: (a) inserting the single thickness portion of the form, top edge first, into a machine for reading the machine readable indica on the single thickness portion; (b) reading the machine readable indicia with the machine; (c) advancing the form in the machine from top edge toward bottom edge so that the triple plies of the form enter the machine; and (d) printing on the top ply top face with the machine.

It is a primary object of the present invention to provide an effective multiply guest check for use with automatic reading equipment or the like. This and other objects of the invention will become clear from an inspection of the detailed description of the invention, and from the appended claims.

DETAILED DESCRIPTION OF THE DRAWINGS

Figure 1:
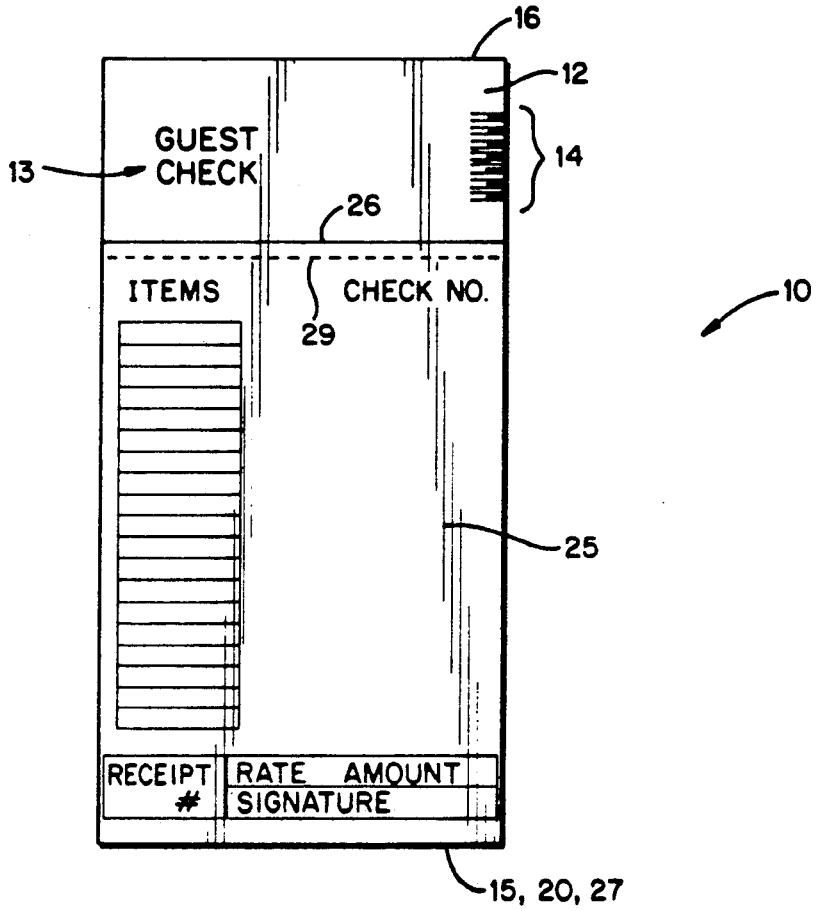
FIG. 1 is a top plan view of an exemplary guest check business form according to the invention.
Figure 2:
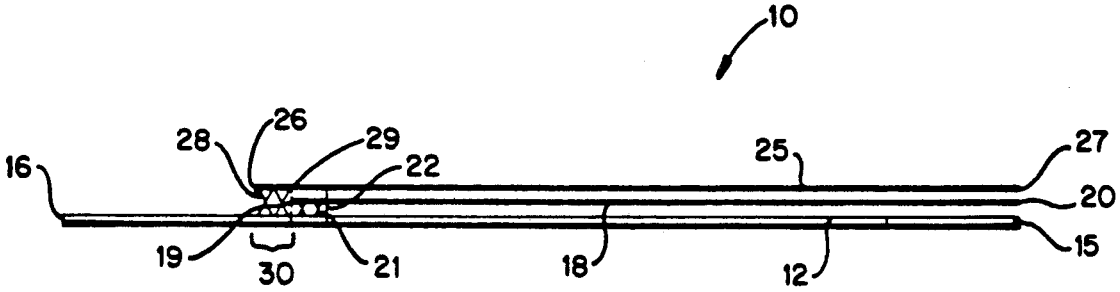
FIG. 2 is a side schematic view of the form of FIG. 1.

An exemplary guest check business form according to the invention is shown generally by reference numeral 10 in FIGS. 1 and 2. It comprises a first ply 12 having indicia such as 13, 14 printed thereon, and having a predetermined length and width, and a bottom edge 15 and a top edge 16. The indicia 13 is human readable indicia, and is optional. The indicia 14 is machine readable indicia, and is preferably provided. As illustrated in FIG. 1, it is preferred that the machine readable indicia are bar code symbols, such as of the type disclosed in U.S. Pat. No. 4,772,048 and the patents mentioned therein. The first ply 12 is preferably of relatively heavy weight paper, e.g. paper having a weight of about twice the weight of the other plies. For example, the ply 12 may be made of 35 pound CF carbonless paper.

The form 10 also comprises a second ply 18 (FIG. 2). The ply 18 has a top edge 19 and a bottom edge 20. The top edge 19 is spaced from the top edge 16 of the form 10, the indicia 13, 14 being provided in that portion of the top face of the first ply 12 above the edge 19.

The second ply 18 is connected to the first ply 12 by first adhesive means 21 directly connecting the plies 12, 18 together adjacent the top edge 19 of the second ply 18. The adhesive 21 may be repositionable adhesive, such as provided in a product sold by Moore Business Forms, Inc. under the trademark "Note Stix" or by 3M under the trademark "PostIt". Alternatively, the adhesive 21 may be a conventional permanent adhesive of the type commonly used in guest checks and other business forms. If it is permanent adhesive, it is desirable—although not absolutely necessary—that perforations 22 be provided adjacent that portion of the adhesive line 21 closest to the bottom edge 20. The perforations may be fine perforations, of the type in a product sold by Moore Business Forms under the trademark "Keen Edge". That is, there may be 50 or more perforations per inch, with ties of no more than 0.010 inches between them.

Note that the second ply 18 is connected to the first ply 12 only at the adhesive line 21. The second ply 18 preferably has a weight of about 15 pounds (e.g. 14.5 pound carbonless CFB paper).

A third ply 25 is provided overlying the second ply 18. The third ply 25 has a top edge 26 and a bottom edge 27 and is attached by second adhesive means 28 to the other plies. Preferably the second adhesive means 28—as illustrated in FIG. 2—attaches the third ply 25 directly to the top face of the first ply 12, and the width 30 of the second adhesive strip 28 is such that the adhesive strips 21, 28 are staggered so that at no point does the form 10 have adhesive more than one layer thick. The second adhesive 28 is the only means for attaching the third ply 25 to the other plies.

Note that the third ply 25 is preferably slightly longer than the second ply 18, and that the bottom edge 27 thereof is in substantial alignment with the edges 20, 15. The top edge 26 of the third ply 25 is spaced from the top edge 16 of the first ply 12, again the indicia 14 being provided on the single thickness portion of the first ply 12 above the edge 26.

The second adhesive 28 also may be repositionable or permanent adhesive. Where it is permanent adhesive, preferably perforations 29 are provided, perforations 29 being substantially even with the top edge 19 of the second ply 18. The perforations 29 again can be very fine perforations. The top ply 25 is preferably made of about 15 pound carbonless CB paper.

The form 10 is typically used in association with a machine for reading the bar code 14 and printing on the form, including the top face of the third ply 25. The machine reads the indicia 14, and ultimately advances the form 10 in the machine from the top edge 16 toward the bottom edge 15 so that all three plies of the form enter the machine. As the form is advanced, the machine prints on the top face of the top ply 25, such as along lines thereof indicated by the indicia "items" in the exemplary embodiment illustrated in FIG. 1.

It is noted that while the form 10 has been described with respect to three plies, instead of three plies, four or even more plies may be provided. Any other plies would be provided between the top ply 25 and the bottom ply 12, and would preferably have a length intermediate that of the second ply 18 and the third ply 25.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A business form comprising:

a first ply having indica printed on a first face thereof, and having a length and width, a top edge, and a bottom edge;

a second ply having substantially the same width as said first ply, but a shorter length, and having a top edge and a bottom edge;

first adhesive means for attaching said second ply directly to said first ply first face adjacent said top edge of said second ply so that said bottom edges thereof are in substantial alignment, and said top edge of said second ply is spaced from said top edge of said first ply;

a third ply having substantially the same width as said first and second plies, and having a top edge and a bottom edge, and having a length less than that of said first ply, and having indicia printed on a first face thereof;

second adhesive means, comprising a single adhesive strip for operatively attaching said third ply directly to said first ply so that said bottom edges thereof are in substantial alignment, and said top edge of said third ply is spaced from said top edge of said first ply, said third ply overlying said second ply, said first face of said third ply facing away from said second ply, said plies being connected together only by said first and second adhesive means; and said first and second adhesive means are staggered along the length of said first ply so that at no point does the business form have adhesive more than one layer thick.

2. A business form as recited in claim 1 wherein said third ply has a length greater than said second ply.

3. A business form as recited in claim 1 wherein said second adhesive means attaches said third ply directly to said first ply.

4. A business form as recited in claim 1 wherein said first ply has a weight of about 35 pounds, and said second and third plies have a weight of about 15 pounds each.

5. A business form as recited in claim 1 wherein said first ply comprises carbonless CF paper, said second ply comprises carbonless CFB paper, and said third ply comprises carbonless CB paper.

6. A business form as recited in claim 1 wherein said first and second adhesive means comprises repositionable adhesive.

7. A business form as recited in claim 1 wherein said adhesive means comprise permanent adhesive.

8. A business form as recited in claim 7 further comprising perforations formed in said second and third plies adjacent the portion of said adhesive means closest to the bottom edge of the respective ply.

9. A business form as recited in claim 8 wherein said perforations are fine perforations of at least 50 perforations per inch, with ties of no more than 0.010 inches in length between them.

10. A business form as recited in claim 1 wherein said first ply is substantially heavier than each of said second and third plies.

11. A business form as recited in claim 10 wherein said first ply has a weight of about 35 pounds, and said third and second plies have a weight of about 15 pounds each.

12. A business form as recited in claim 1 wherein said indicia on said first ply includes machine readable indicia printed on the portion of said first ply between the top edge of said first ply and the top edges of said second and third plies.

13. A business form as recited in claim 12 wherein said third ply has a length greater than said second ply, and wherein said second adhesive means attaches said third ply directly to said first ply.

14. A business form as recited in claim 13 wherein said first ply is roughly about twice as heavy as each of said second and third plies.

15. A business form as recited in claim 14 wherein said first and second adhesive means are repositionable adhesive.

16. A business form as recited in claim 14 wherein said adhesive means are permanent adhesive, and further comprising perforations formed in said second and third plies adjacent a portion of said adhesive means closest to said bottom edge.

17. A guest check business form consisting essentially of:

a first ply having machine readable indicia printed on a first face thereof and having a first length and width, a top edge, and a bottom edge;

a second ply having substantially the same width as said first ply, but of shorter length, and having a top and bottom edge;

first adhesive means for attaching said second ply directly to said first ply first face so that said bottom edges thereof are in alignment, and said top edge of said first ply is spaced from said top edge of said second ply;

a third ply having a length greater than that of said second ply but less than that of said first ply, having substantially the same width as said first and second plies and a top and bottom edge;

second adhesive means, comprising a single adhesive strip for operably attaching said third ply directly to said first ply adjacent said top edge thereof, so that said bottom edges are in alignment, and said top edge of said third ply is spaced from said top edge of said first ply, said third ply overlying said first ply, and said first and second adhesive means being staggered along the length of said first ply so that at no point does the business form have adhesive more than one layer thick; and said machine readable indicia printed on said first ply first face being printed thereon between said top edge of said first ply and said top edge of said third ply.

18. A guest check business form as recited in claim 17 wherein said adhesive means are repositionable adhesive.

* * * * *